US006406019B1

(12) United States Patent
Joyner et al.

(10) Patent No.: US 6,406,019 B1
(45) Date of Patent: Jun. 18, 2002

(54) METHOD OF DETERMINING A LOTTERY WINNER

(75) Inventors: John F. Joyner, Sebring, FL (US); Jeffrey S. Melcher, 9200 Burning Tree Rd., Bethesda, MD (US) 20817

(73) Assignee: Jeffrey S. Melcher, Bethesda, MD (US)

( * ) Notice: Subject to any disclaimer, the term of this patent is extended or adjusted under 35 U.S.C. 154(b) by 0 days.

(21) Appl. No.: 09/737,558

(22) Filed: Dec. 18, 2000

Related U.S. Application Data

(60) Provisional application No. 60/171,600, filed on Dec. 23, 1999, and provisional application No. 60/175,308, filed on Jan. 10, 2000.

(51) Int. Cl.[7] ..... A63B 71/00

(52) U.S. Cl. ..... 273/138.1; 273/139; 463/40

(58) Field of Search ..... 273/138.1, 139; 463/40, 7, 16, 41

(56) References Cited

U.S. PATENT DOCUMENTS 4,174,857 A * 11/1979 Koza ..... 283/6
4,191,376 A * 3/1980 Goldman et al. ..... 273/139
4,398,708 A * 8/1983 Goldman et al. ..... 270/18
4,832,341 A * 5/1989 Muller et al. ..... 273/139
5,129,652 A * 7/1992 Wilkinson ..... 273/139
5,239,165 A * 8/1993 Novak ..... 235/375
5,273,281 A * 12/1993 Lovell ..... 273/138 R
5,283,734 A * 2/1994 Von Kohorn ..... 364/412
5,286,061 A * 2/1994 Behm ..... 283/95
5,417,424 A * 5/1995 Snowden et al. ..... 273/138 A
5,599,046 A * 2/1997 Behm et al. ..... 283/83
5,713,795 A * 2/1998 Kohorn ..... 463/17
5,791,990 A * 8/1998 Schroeder et al. ..... 463/17
5,855,514 A * 1/1999 Kamille ..... 463/17
5,871,398 A * 2/1999 Schneier et al. ..... 463/16
5,927,716 A * 7/1999 Goodson et al. ..... 273/269
5,931,467 A * 8/1999 Kamille ..... 273/193
5,934,671 A * 8/1999 Harrison ..... 273/139
5,996,997 A * 12/1999 Kamille ..... 273/139
6,053,405 A * 4/2000 Irwin, Jr. et al. ..... 235/375
6,145,885 A * 11/2000 Scrymgeour et al. ..... 283/94
6,237,913 B1 * 5/2001 Kamille ..... 273/139

* cited by examiner

*Primary Examiner*—Benjamin H. Layno
*Assistant Examiner*—Dolores R. Collins
(74) *Attorney, Agent, or Firm*—Jeffrey S. Melcher; Manelli Denison & Selter, PLLC

(57) ABSTRACT

Provided is a method of determining a lottery winner having the steps of providing lottery tickets each having at least one purchaser selected group of numbers and a purchase time, drawing a drawn group of numbers from a pool of numbers, selecting a winning group of numbers which have the most numbers matching between the purchaser selected group of numbers and the drawn group of numbers, and selecting a lottery winner from the winning group of numbers based on the earliest purchase time.

29 Claims, No Drawings

METHOD OF DETERMINING A LOTTERY WINNER

This application claims priority to U.S. Ser. Nos. 60/171,600, filed on Dec. 23, 1999, abandoned, and U.S. Ser. No. 60/175,308, filed on Jan. 10, 2000, abandoned, the complete disclosures of which are incorporated herein by reference.

FIELD OF THE INVENTION

The invention relates to a method of determining a lottery winner.

BACKGROUND OF THE INVENTION

Typical lotteries have many disadvantages. For example, the well known "Powerball" does not always have a winner at each drawing. Furthermore, there is no incentive for purchasing lottery tickets early, which often results in a large variation of demand for lottery tickets. There is usually little demand during the initial offering of the lottery and greater demand near the conclusion of the lottery.

There is a need for a method of determining a lottery winner which provides an incentive to purchase lottery tickets early and provides a winner at each drawing.

SUMMARY OF THE INVENTION

An objective of the invention is to provide a method of determining a lottery winner which provides an incentive to purchase lottery tickets early and provides a winner at each drawing.

The above objective and other objectives are achieved by the present invention. The present invention provides a method of determining a lottery winner comprising:

- providing lottery tickets each having at least one purchaser selected group of numbers and a purchase time;
- drawing a drawn group of numbers from a pool of numbers;
- selecting a winning group of numbers which have the most numbers matching between the selected group of numbers and the drawn group of numbers; and
- selecting a winner from the winning group of numbers based on the earliest purchase time.

DETAILED DESCRIPTION OF PREFERRED EMBODIMENTS

The present invention relates to a method of determining a lottery winner comprising providing lottery tickets each having a purchaser selected group of numbers and a time of purchase, drawing a drawn group of numbers from a pool of numbers, selecting a winning group of numbers which have the most numbers matching between the purchaser selected group of numbers and the drawn group of numbers, and selecting a winner from the winning group of numbers based on the earliest purchase time.

The lottery tickets include at least one purchaser selected group of numbers from the pool of numbers and a purchase time. The purchaser can select the group of numbers or a random selection can be provided by the ticketing machine. The purchaser selected group of numbers can be any desired amount. Preferred amounts of selected numbers are from about 3 to about 10 numbers, and more preferably from about 5 to about 8 numbers. The lottery tickets can include multiple selected groups of numbers if desired, such as in the well known "Powerball" lottery.

The purchase time on the ticket must include the date the ticket was purchased at the very least. The purchase time preferably includes the time of day the ticket was purchased to the nearest minute, and more preferably to the nearest second. Typical lottery machines already print the date, and many also print the time of purchase on tickets. Thus, very little, if any modifications to conventional lottery machinery are required to practice the present invention.

Any amount of numbers can be used to form the pool of numbers. However, the pool of numbers should be large enough to reduce the number of ties in the winning group of numbers. Preferred amounts are from about 30 to about 70 numbers, more preferably from about 40 to about 60 numbers. The pool of numbers can also comprise two groups of numbers, as in the well known "Powerball" lottery, or more groups as desired.

A predetermined number of numbers is drawn from the pool of numbers to form a group of drawn numbers. The selection of the drawn numbers can be performed using any of the methods used in conventional lotteries, such as numbered balls. The predetermined number in the drawn group of numbers should be the same quantity of numbers as the quantity of numbers in the purchaser selected group. However, the predetermined number can be greater than the quantity of numbers in the purchaser selected group. The predetermined number can be any amount desired. Preferably, the predetermined number is large enough to reduce the number of ties in the winning group of numbers. In this regard, the drawn group of numbers is preferably from about 3 to about 10 numbers, and more preferably from about 5 to about 8 numbers.

A winner is selected as follows. The greatest number of matching numbers between the purchaser selected group and the drawn group determines the winning group of numbers. For example, if there are more than one purchaser selected groups having the greatest number of matches with the drawn group such that there is a tie, that group of selected groups is referred to as the winning group of numbers. The winner is the purchaser selected group in the winning group of numbers which has the earliest purchase date. For example, if the predetermined quantity of numbers in the drawn group is five and there are three purchaser selected groups having four matching numbers, the winner is the purchaser selected group that has the earliest purchase time among the purchaser selected groups having four matching numbers. If, by the rare chance, two or more purchaser selected groups in the winning group of numbers have the same purchase time, the winnings can be split equally or the tie can be broken as in conventional lotteries.

In order to facilitate early redemption of the winning ticket, the winner can be required to redeem the winning ticket within a selected winning redemption period. Any time period can be used. For example, the winning time period can be from about 1 day to about a year, preferably about 1 week to about 6 months, more preferably about 1 week to about 3 months, from the time of the drawing. If the winning ticket is not redeemed within the winning redemption period, the ticket with the next earliest purchase date in the winning group of numbers can be selected as the overall winner. This process can be repeated until a winning ticket is redeemed.

Typically, lotteries payout proceeds for the winning ticket as well as paying tickets having fewer matching numbers between the purchaser selected group the drawn group of numbers, in decreasing amounts as the number of matching numbers decreases. There is usually a redeeming time period of, for example about 1 year, for redeeming the paying tickets for proceeds, after which no proceeds are paid. The winning redemption period can be shorter than the time period required for redeeming all paying tickets. In the present invention, if the winning ticket is not redeemed, that ticket may still be redeemed for the payout amount accorded to the later purchased wining group of numbers until the redemption time period for all paying tickets is tolled. Alternatively, if the winning ticket is not redeemed within the winning redemption period, the winning proceeds can be distributed to other paying tickets.

Another method of facilitating early redemption of the winning ticket can be to reduce the payout amount of the proceeds as the time the lottery ticket is redeemed from the drawing of the drawn group of numbers increases. For example, for each day following the drawing date, the payout can be reduced by 1% so that after 100 days of no redemption, there is no payout for the winning ticket. The difference between the reduced payout and the total payout for first day redemption can be added to the next lottery, kept by the state, paid to other paying tickets, or used otherwise.

These methods of facilitating early redemption of the winning ticket can be applied in a similar manner to other paying tickets, to facilitate early redemption of lottery tickets. The methods can also be combined if desired.

Usually, lottery drawings are televised at predetermined times. The use of a winning time period will increase viewership of the lottery drawing, since lottery players will want to know if they have a paying ticket as early as possible in order to maximize the amount of the proceeds.

The present invention provides the advantages of determining a winner for each lottery and providing an incentive to purchase the lottery tickets early. The lottery can be run during any desired time frame, such as weekly or biweekly, as desired.

The amount of money or other winnings for the lottery can be determined as desired for the particular application.

If desired, letters of the alphabet or other symbols can be used in place of the numbers.

Examples of suitable lottery names for the novel methods described herein include "High Noon Lottery", "Shoot Out Lottery", or "Quick Draw Lottery".

The methods of facilitating early redemption of the winning ticket described herein with reference to the above embodiments, can be applied in a similar to conventional lotteries, which do not use purchase time to determine a lottery winner. In particular, the winning redemption period and/or the reduced payout schedule can be utilized in conventional lotteries.

The present invention will now be explained with reference to the following non-limiting examples.

EXAMPLE 1

This lottery has the following conditions:

The pool of numbers is 50, numbered 1 to 50.

The number of drawn number of numbers is 6.

The number of purchaser selected numbers is 6.

The purchase date and time printed on each ticket down to nearest minute for each player is shown in Table 1.

TABLE 1

| Player No. | Purchase Time | Purchaser Selected Nos. | | | | | |
|---|---|---|---|---|---|---|---|
| 1 | 1/3/00 10:36* | 3 | 12 | 16 | 24 | 32 | 46 |
| 2 | 1/5/00 12:50 | 3 | 12 | 16 | 25 | 32 | 45 |
| 3 | 1/3/00 13:45 | 4 | 12 | 16 | 24 | 32 | 45 |
| 4 | 1/6/00 17:04 | 5 | 12 | 16 | 24 | 32 | 43 |

*Time in 24 hour military time. Can be conventional AM/PM if desired.

The drawn numbers are 3, 12, 16, 24, 32 and 45.

Players 1, 2 and 3 each have 5 matching numbers between the purchaser selected numbers and the drawn numbers. Therefore, players 1, 2 and 3 make up the winning group of numbers. Since player 1 has the earliest purchase time, player 1 is the winner.

EXAMPLE 2

In this example, a winning redemption period of one month is utilized, for the lottery of Example 1. Player 1 does not redeem the winning ticket within the one month redemption period and therefore player 3 is selected as the winner since player 3 has the next earliest purchase time. Player 1 still can receive the payout of proceeds, if any, for tickets in the winning group of numbers.

EXAMPLE 3

In this example, a reduced payout schedule is utilized, for the lottery of Example 1. For each day after the drawing the lottery ticket is redeemed, the proceeds are reduced by 1%. The drawing is on Jan. 13, 2000 and player 1 redeems the winning ticket on Jan. 30, 2000. Player 1's proceeds are reduced by 17% (number of days from January 13 to January 30).

While the claimed invention has been described in detail and with reference to specific embodiments thereof, it will be apparent to one of ordinary skill in the art that various changes and modifications can be made to the claimed invention without departing from the spirit and scope thereof.

What is claimed is:

1. A method of determining a lottery winner comprising:

providing lottery tickets each having at least one purchaser selected group of numbers and a purchase time;

drawing a drawn group of numbers from a pool of numbers;

selecting a winning group of numbers which have the most numbers matching between the purchaser selected group of numbers and the drawn group of numbers; and selecting a lottery winner from the winning group of numbers based on the earliest purchase time if there is more than one purchaser selected group of numbers in the winning group of numbers.

2. A method according to claim 1, wherein said pool of numbers comprises from 30 to 70 numbers.

3. A method according to claim 1, wherein said pool of numbers comprises from 40 to 60 numbers.

4. A method according to claim 1, wherein said purchase time is calculated based on day and time of day down to the nearest minute.

5. A method according to claim 1, wherein said purchase time is calculated based on day and time of day down to the nearest second.

6. A method according to claim 1, wherein said purchaser selected group of numbers comprises from about 3 to about 10 numbers.

7. A method according to claim 1, wherein said purchaser selected group of numbers comprises from about 5 to about 8 numbers.

8. A method according to claim 1, wherein said drawn group of numbers comprises from about 3 to about 10 numbers.

9. A method according to claim 1, wherein said drawn group of numbers comprises from about 5 to about 8 numbers.

10. A method according to claim 1, wherein said pool of numbers comprises two groups of numbers.

11. A method according to claim 1, further comprising the step of imposing a winning redemption period for redeeming a winning lottery ticket.

12. A method according to claim 11, wherein the winning redemption period is less than the redemption period imposed for other paying tickets.

13. A method according to claim 11, wherein said winning redemption period is from about 1 day to about a year.

14. A method according to claim 11, wherein said winning redemption period is about 1 week to about 6 months.

15. A method according to claim 11, wherein said winning redemption period is about 1 week to about 3 months.

16. A method according to claim 1, further comprising imposing a reduced payout schedule in which an amount of proceeds is reduced as the time the lottery ticket is redeemed from the drawing of the drawn group of numbers increases.

17. A method according to claim 16, wherein an amount of proceeds is reduced by 1% for each day after the date of the drawing of the drawn group of numbers.

18. A method according to claim 1, further comprising imposing a reduced payout schedule in which an amount of proceeds for the lottery winner is reduced as the time from the drawing of the drawn group of numbers is increased.

19. A method of determining a lottery winner comprising:

providing lottery tickets each having at least one purchaser selected group of numbers and a purchase time;

drawing a drawn group of numbers from a pool of numbers;

selecting a winning group of numbers which have the most numbers matching between the purchaser selected group of numbers and drawn group of numbers;

selecting a lottery winner from the winning group of numbers based on the earliest purchase time; and imposing a reduced payout schedule in which the amount of proceeds is reduced as the time the lottery ticket is redeemed from the drawing of the drawn group of numbers increases.

20. A method according to claim 19, wherein the amount of proceeds is reduced by 1% for each day after the date of the drawing of the drawn group of numbers.

21. A method according to claim 19, wherein amount of proceeds for the lottery winner is reduced as the time from the drawing of the drawn group of numbers is increased.

22. A method of determining a lottery winner comprising:

providing lottery tickets each having at least one purchaser selected group of numbers and a purchase time;

drawing a drawn group of numbers from a pool of numbers;

selecting a winning group of numbers which have the most numbers matching between the purchaser selected group of numbers and drawn group of numbers;

selecting a lottery winner from the winning group of numbers based on the earliest purchase time; and imposing a winning redemption period for redeeming a winning lottery ticket.

23. A method according to claim 22, wherein the winning redemption period is less than the redemption period imposed for other paying tickets.

24. A method according to claim 22, wherein said winning redemption period is from about 1 day to about a year.

25. A method according to claim 22, wherein said winning redemption period is about 1 week to about 6 months.

26. A method according to claim 22, wherein said winning redemption period is about 1 week to about 3 months.

27. A method of determining a lottery winner comprising:

providing lottery tickets each having at least one purchaser selected group of numbers;

drawing a drawn group of numbers from a pool of numbers;

selecting at least one lottery winner which has the most numbers matching between the purchaser selected group of numbers and drawn group of numbers; and imposing a reduced payout schedule in which the amount of proceeds is reduced as the time the lottery ticket is redeemed from the drawing of the drawn group of numbers increases.

28. A method according to claim 27, wherein the amount of proceeds is reduced by 1% for each day after the date of the drawing of the drawn group of numbers.

29. A method according to claim 27, wherein amount of proceeds for the lottery winner is reduced as the time from the drawing of the drawn group of numbers is increased.

* * * * *